United States Patent [19]

Hauschulte

[11] Patent Number: 4,627,650

[45] Date of Patent: Dec. 9, 1986

[54] CLASP FOR CLOSABLE ARTICLES

[75] Inventor: Franz Hauschulte, Menden, Fed. Rep. of Germany

[73] Assignee: Sudhaus Schloss- und Beschlagetechnik GmbH & Co., Iserlohn, Fed. Rep. of Germany

[21] Appl. No.: 725,325

[22] Filed: Apr. 19, 1985

[30] Foreign Application Priority Data

Apr. 19, 1984 [DE] Fed. Rep. of Germany ... 8412303[U]

[51] Int. Cl.[4] ..... E05C 5/02

[52] U.S. Cl. ..... 292/113; 292/DIG. 49

[58] Field of Search ..... 292/66, 113, 247, DIG. 31, 292/DIG. 49, 110

[56] References Cited

U.S. PATENT DOCUMENTS

| | | | |
|---|---|---|---|
| D. 200,974 | 4/1965 | Gehrie | D50/7 |
| D. 249,457 | 9/1978 | Stolarz | D8/338 |
| 1,522,179 | 1/1925 | Garrigus . | |
| 2,672,040 | 3/1954 | Komenak | 70/76 |
| 2,795,946 | 6/1957 | Check | 70/76 |
| 3,134,617 | 5/1964 | Slonneger | 292/113 X |
| 3,237,978 | 3/1966 | Swanson | 292/247 X |
| 3,321,230 | 5/1967 | Stollman | 292/113 |
| 3,434,314 | 3/1969 | Atkinson | 70/76 |
| 3,534,992 | 10/1970 | Swanson | 292/247 X |
| 3,584,906 | 6/1971 | Budzyn | 292/247 |
| 3,885,407 | 5/1975 | Feinberg | 292/247 X |
| 4,008,584 | 2/1977 | Wingert | 292/247 X |
| 4,300,794 | 11/1981 | Dunsmoor | 292/247 |
| 4,428,608 | 1/1984 | Cooke et al. | 292/247 |

FOREIGN PATENT DOCUMENTS

| | | |
|---|---|---|
| 571603 | 3/1933 | Fed. Rep. of Germany . |
| 2006676 | 2/1970 | Fed. Rep. of Germany . |
| 1022495 | 4/1970 | Fed. Rep. of Germany . |
| 7012175 | 4/1970 | Fed. Rep. of Germany . |
| 389123 | 9/1908 | France . |
| 343222 | 2/1931 | United Kingdom . |
| 411621 | 2/1931 | United Kingdom . |
| 600427 | 6/1934 | United Kingdom . |

*Primary Examiner*—Richard E. Moore

*Attorney, Agent, or Firm*—Karl F. Ross; Herbert Dubno

[57] ABSTRACT

A luggage, handbag or like clasp for a receptacle has a tension member engaging over an upper clasp part when a lever is displaced, the lever being connected to the tension member by a pair of independent links. The tension member and the base plate are provided with camming surfaces which swing the tension member outwardly when the lever is swung into its open position and inwardly when the lever is swung into its closed position.

8 Claims, 5 Drawing Figures

CLASP FOR CLOSABLE ARTICLES

FIELD OF THE INVENTION

My present invention relates to a clasp for closable articles and more particlularly, to a clasp for cases, especially suitcases and attache cases, luggage of all types, bags, receptacles, purses and the like, all of which can be generically referred to as receptacles, and which can have two parts which, upon closing of the clasp, can be locked together.

BACKGROUND OF THE INVENTION

A clasp for receptacles of the aforedescribed type which has gained widespead usage, employs a tension element which is swingably mounted on a bottom part and engages over a top part of the clasp when a lever is actuated to draw the top part against the bottom part and lock the assembly. A toggle linkage or the like can be provided for actuating the pivotal tension applying member so that the shifting of the lever, for example, past a deadcenter position, will retain the clasp in its closed position which represents one of the stable positions of the lever.

Basically, therefore, the clasp can comprise an upper part which can be fixed to one receptacle half or portion, a lower part which can be fixed to the upper receptacle half or portion and a substantially U-shaped member or bail swingably mounted on the lower part and engageable over a projecting portion of the upper part to draw the latter against the lower part.

The lower part may be a mounting or base plate upon which the actuating lever is swingably mounted on to which the U-shaped member is articulated.

Such a clasp is described in German Pat. No. 20 06 676. In this clasp, a special articulation element is provided for connecting the clasp bail with the actuating lever, the ends of these connecting elements being swingably mounted at the ends of the arms of the actuating lever. This element has the cross section or profile of a hat with a base portion connected to the lever, two shanks extending therefrom at right angles to the same side and two opposite extending legs parallel to the base section and perpendicular to these shanks.

This separate connecting element, engages a sheet metal portion of the actuating lever which is rivetted to the latter. In practice, this construction takes up much of the closing force developed over the clasp when the latter is locked and is highly stressed so that failure is reasonably frequent.

The bail itself has fingers which are guided in slots of the base plate proximal to the underlying material from which the purse, suitcase or carrying bag can be fabricated, so that strands of this material can jam in the slots and interfere with effective operation of the clasp.

German patent No. 10 22 495 shows a similar clasp which also uses a connecting element fastened to the lever and which is exposed or accessible to damage at least in the open position of the clasp and which is sensitive to distortion.

While a different construction is provided in German utility model DE-GEM No. 70 12 175, this clasp requires a number of springs and rivet pins so that assembly of the clasp is not only expensive, but difficult; its reliability leaves much to be desired.

A German open application DE-OS No. 29 20 878 describes a clasp in which the movement of the tension lever is transmitted to the bail via pins in respective guides. With this closure fabrication problems are encountered because the dimension of the device and especially the relationships of the pair of pins with the respective slides is difficult to maintain with the high precision required.

OBJECTS OF THE INVENTION

It is, therefore, the principal object of the present invention to provide an improved clasp for receptacles of the type described whereby these disadvantages are obviated.

Another object of this invention is to provide a clasp for luggage generally, hand bags and other receptacles, using the tension engagement principle, whereby mounting of the clasp and its parts and the fabrication thereof are relatively simple and economical, the number of parts is held to a miniimum and the parts themselves are relatively simple and devoid of any tendency to become blocked or jammed.

It is also an object of my invention to provide an easily acutated clasp-type closure of comparatively small size which is not sensitive to precise tolerances and which likewise is free from any danger of blockage from strands of material arising from the article upon which the clasp is mounted.

SUMMARY OF THE INVENTION

These objects and others which will become apparent hereinafter are attained in accordance with the present invention, byh providing a clasp-type closure of the type described, i.e. having a clasp upper part mounted upon a receptacle upper part, a clasp lower part mounted upon the receptacle lower part and formed as a base plate, an actuating lever pivotably connected to this base plate, and a substantially U-shaped tension member engageable over the upper part of the clasp and operatively connected with the lever to draw the upper part of the clasp against the lower part thereof upon displacement of the lever toward a position in which it is generally parallel to the base plate, but swingable upwardly and outwardly to release the upper part when the lever is swung into a position in which it lies generally transverse to the base plate.

According to my invention, the actuating lever and the tension members are provided along juxtaposed longitudinal edges at their opposite ends, respectively, with pins each projecting toward the other edge juxtaposed therewith and received in a bore or hole of respective links independently disposed between the juxtaposed edges and engaged by the pins thereof. In addition, the base plate, along said longitudinal edges and its upper end is provided with camming formations engagable with camming flanks on said tension member to shift the upper end of said tension member outwardly as said tension member is moved upwardly by the lever coupled therewith through the links.

At the opposite or lower end, also along these longitudinal edges, the base plate is formed with flanks which cooperate with the tension member to swing the tension member in the opposite sense relative to the lever, thereby displacing the upper end of the tension member inwardly as the clasp is closed. As a consequence, the clasp has a relatively simple constuction with few parts and can be fabricated and mounted quickly and easily. Perhaps its greatest advantage, however, is its unobjectionable operation, i.e. the ease and reliability with which it functions.

Advantageously, the base plate is provided with angled portions whose flanks receive with play the links and which can laterally guide the links. The links, in addition, can rest with play against the inner flanks of the tension member so that the links can be fully retained so as not to slip off the pins without additional fastening means.

Advantageously, the pivot pins engageable with the links completely traverse the latter and extend from the tension member to the aforementioned flanks of the base plate.

The actuating lever can be formed at one end with a projecting formation which is operatively connected with a leaf spring affixed to the base plate and which can serve to retain the tension member and the actuating lever in one or both of its extreme positons. Furthermore, the actuating lever can include a lock which can have a locking nose engageable beneath a locking formation on the base plate.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
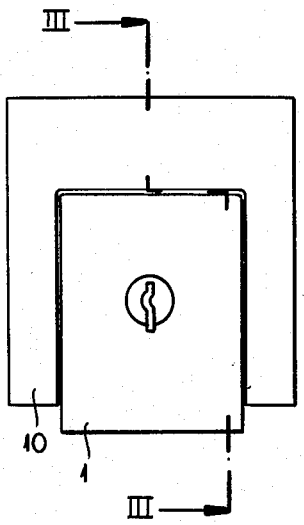
FIG. 1 is an elevational view of a closed clasp according to the invention.
Figure 2:
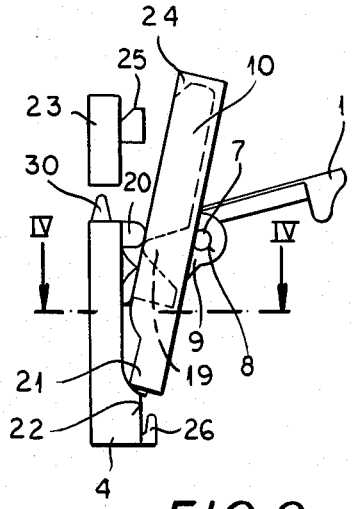
FIG. 2 is a side elevational view of the open clasp.
Figure 3:
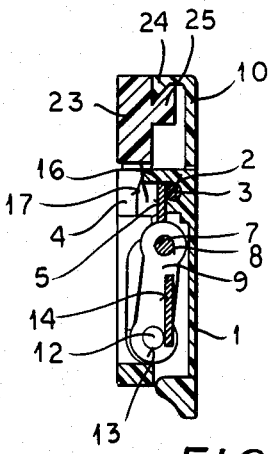
FIG. 3 is a section taken along the line III—III of FIG. 1.
Figure 5:
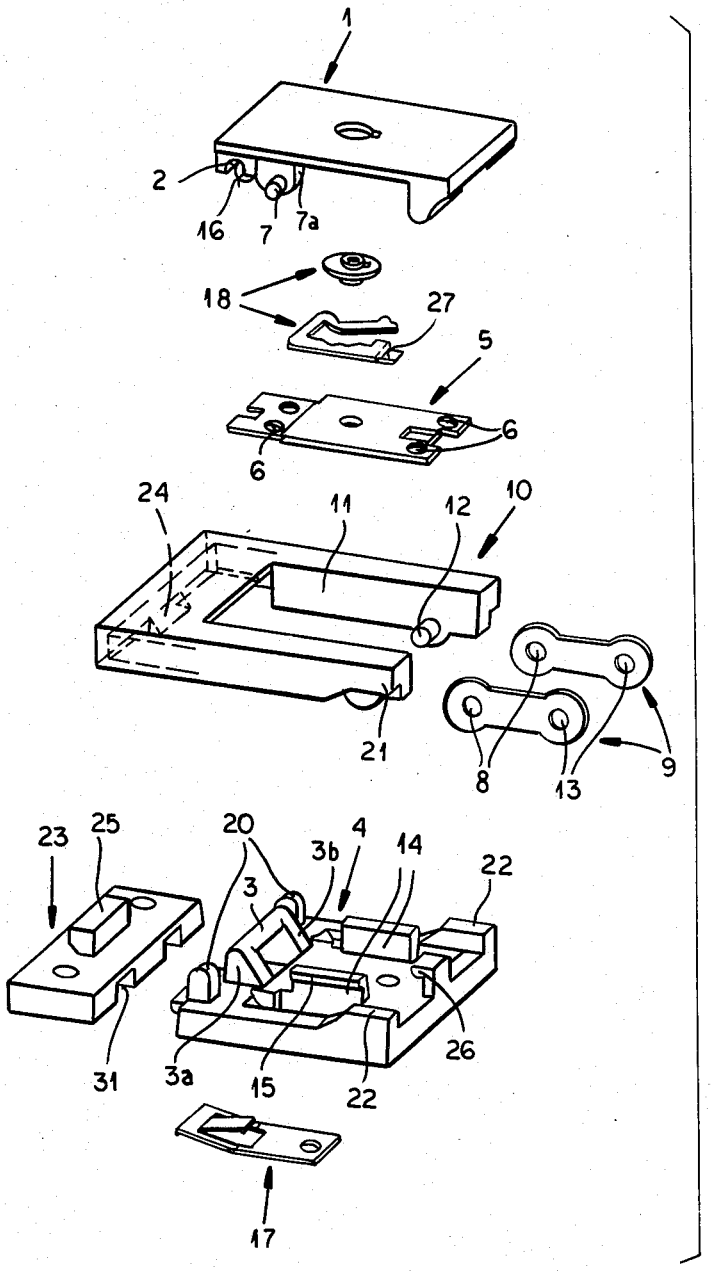
FIG. 5 is an exploded view of the clasp in perspective.

The clasp shown in the drawing comprises an actuating lever 1 which is formed at one end with an inwardly or rearwardly open journal slot or notch 2 adapted to engage a journal bar 3 formed unitarily on a base plate 4, the journal bar being held above the surface of this base plate by a pair of ribs 3*a*, 3*b*. The slot 2 can be pressed over this bar and provides a snap fit therewith which nevertheless allows the lever to swing relative to the base plate in a clockwise direction from the extreme position shown in FIG. 2 to of the extreme position shown in FIG. 3 or, conversely in a counterclockwise direction from the position of this lever shown in FIG. 1 to the position of the lever shown in FIG. 2.

The back of the lever is closed by a retaining plate 5.

The lever 1, which can be injection molded from synthetic resin, can be provided with rivet pins which pass through the bores 6 in the metal retaining plate 5, the heads of the rivet pins being then spread.

The actuating lever 1 is provided with a pair of journal lugs 7*a* at this end and along the opposite longitudinal sides of this lever, bearing pins 7 projecting outwardly from these lugs.

The pins 7 each engage in holes 8 of a pair of links 9. the pins 7 are of such a length that they practically touch the inner flanks of the tension member 10 which have been represented at 11 so that the links 9 cannot slip off the pins.

Figure 4:
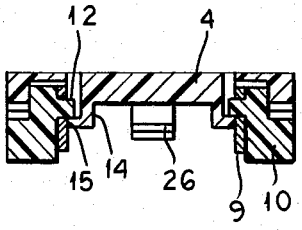
FIG. 4 is a section taken along the line IV—IV of FIG. 2 but rotated through 90°.

The tension member 10, as can be seen from the drawing, is generally U-shaped and is formed along the inner flanks 11, which constitute longidudinal edges juxtaposed with the edges of the lever 1, with inwardly extending pins 12 engaging in bores 13 of the links 9, these pins 12 extending substantially to the overhanging regions of a pair of flanges 14 of the base plate 4, so that the links 9 cannot shift inwardly (see FIG. 4) and the edges of the overhanging portions 14 rest against the links 9 to hold the links on the pins 12.

The lever 1 is provided at the same end as the notch 2 with a formation 16 which is engaged by a leaf spring 17 fixed to the base plate 4 and which is effective to bias the lever 1 yieldably into its limiting positions as described. The lever 1 is provided with a lock represented generally at 18 into which a key can be fitted in a functional manner and which controls a locking nose 27 engageable beneath a locking formation 26 of the base plate 4.

The base plate 4 at its upper side along its longitudinal edges is provided with a pair of upwardly projecting cams 20 and at the opposite side, i.e. the lower side, along these edges with a pair of guide flanks 22.

The cams 20 engage counter cams or flanks 19 along the longitudinal edges of the tension member 10 so that when the lever 1 is swung in its counterclockwise sense to draw the tension member 10 upwardly, the cams 19 and 20 simultaneously cam the upper portion of the tension member 10 outwardly. Conversely, when the lever 1 is swung in the clockwise sense to entrain the tension member downwardly, the flanks 21 and 22 swing the lower end of the tension member 10 outwardly and hence the uper end inwardly.

In operation, to close the clasp, therefore, the upper clasp part 23 having a ridge 25 with an undercut, is brought into alignment with a tongue 30 projecting upwardly from the base plate 4 so that this tongue can engage in recesses 31 of the upper part 23. The lever 1 is then swung downwardly and the tension member 10 thereby swung inwardly, i.e. to the left, from the position shown in FIG. 2 so that the undercut 24 engages in the formation 25 and draws the latter downwardly to bring the tongues 30 into the recesses 31 and lock the clasp in the position shown in FIG. 3.

I claim:

1. In combination with a receptacle having an upper portion and a lower portion, a clasp comprising;

an upper part affixed to said upper portion and having a projection;

a base plate supporting a lower part of said clasp and fixed to said lower portion;

an actuating lever pivotally mounted on said base plate and having a pair of opposite longitudinal edges along longitudinal edges of said base plate;

a U-shaped tension member having legs straddling said lever and providing respective longitudinal edges respectively juxtaposed with the longitudinal edges of said lever, said tension member being engageable with said projection to draw said parts together, the juxtaposed longitudinal edges of said lever and said member being provided at opposite ends with respective pins each extending toward the other longitudinal edge; and a pair of links each received between two of said juxtaposed edges and traversed by the said pins thereof for coupling said lever to said tension member, said base plate being formed along its longitudinal edges at an upper side thereof with a pair of cams engageable with cams formed on said legs for biasing said tension member outwardly upon swinging movement of said lever into an open position said base plate being formed with respective flanks along its longitudinal edges at a lower side of said plate engageable with said tension member for biasing an upper portion of said tension member inwardly against said upper part upon swinging movement of said lever in an opposite sense into a closed position of said lever.

2. The clasp defined in claim 1 wherein said plate is provided with a pair of flanges having outwardly bent portions engaging with play against said links.

3. The clasp defined in claim 2 wherein said links rest with play against inner flanks of said arms.

4. The clasp defined in claim 3 wherein said pins of said closure member extend beneath the outwardly bent portions of said flanges.

5. The clasp defined in claim 1 wherein said lever is formed at an upper side with a projection extending toward said base plate, further comprising a leaf spring mounted on said base plate and engaging said projection on said lever for yeildably biasing said lever into said open position and said closed position.

6. The clasp defined in claim 1 wherein said lever is formed with a lock having a locking nose engaging beneath a formation of said base plate.

7. The clasp defined in claim 4 wherein said lever is formed at said base upper side with a projection, further comprising a leaf spring mounted on said plate and engaging said projection on said lever.

8. The clasp defined in claim 7 wherein said lever is formed with a lock having a locking nose engaging beneath a formation on said base plate.

* * * * *